United States Patent [19]

Kim

[11] Patent Number: 4,771,556

[45] Date of Patent: Sep. 20, 1988

[54] SPORT SHOE WITH MELODY EMITTING DEVICE

[75] Inventor: Young J. Kim, Namcheun-Dong, Rep. of Korea

[73] Assignee: Samwha Co., Busan, Rep. of Korea

[21] Appl. No.: 84,889

[22] Filed: Aug. 13, 1987

[30] Foreign Application Priority Data

Oct. 10, 1986 [KR] Rep. of Korea ..... 86-15491

[51] Int. Cl.[4] ..... A43B 23/00; A43B 11/00

[52] U.S. Cl. ..... 36/139; 36/136; 36/50

[58] Field of Search ..... 36/139, 132, 136, 50; 84/1.18

[56] References Cited

U.S. PATENT DOCUMENTS 4,043,241 8/1977 Liu ..... 36/139
4,282,657 8/1981 Antonious ..... 36/50
4,413,431 11/1983 Cavanagh ..... 36/50
4,642,914 2/1987 Caldeira ..... 36/50
4,646,350 2/1987 Batra ..... 36/50
4,702,140 10/1987 Goldfarb ..... 84/1.18

*Primary Examiner*—Steven N. Meyers
*Attorney, Agent, or Firm*—Sandler & Greenblum

[57] ABSTRACT

A musical shoe comprises an upper portion attached to a sole portion including a heel and a movable band attached to the upper portion of the shoe for holding it to the foot of a wearer when the band is moved to a closed position, and for effecting removal of the shoe from the foot when the band is moved to an opened position. A circuit panel is mounted on the upper portion of the shoe for producing a speaker drive signal when activated. A speaker is mounted on the shoe and is responsive to a speaker drive signal produced by the circuit panel, for producing an audio signal. A power supply, in the form of a photovoltaic cell, is provided for activating the circuit panel only in response to movement of the band to its opened position.

8 Claims, 2 Drawing Sheets

SPORT SHOE WITH MELODY EMITTING DEVICE

TECHNICAL FIELD

This invention relates to children's sport shoes into which a melody emitting device is incorporated.

BACKGROUND ART

Sport shoes are known in which devices emitting sound are incorporated into the heels of the shoes so that the sound might amuse the wearer. These devices can be applied only to sandal-type shoes fabricated so as to have, inside the heel portion thereof, sufficient room to permit deflection during walking for actuating the device. For this reason, this approach is not applicable to conventional sport shoes. Moreover, the above-mentioned conventional device can produce merely a monotonous sound repeatedly at each step with result that the sound fails to hold a child's interest over a long period of time.

An object of the present invention, therefore, is to provide a musical shoe in which the shoe emits a melody in the event that the shoe is about to slip from the wearer's foot due to loosening of a sticking band that is provided to secure the shoe to the foot of a wearer. If this situation occurs while the wearer is jogging or playing games, such as football, or when the wearer puts on or takes off the shoes, a signal is given that arouses the child's interest in wearing the shoes with safety and amusement by properly resecuring the sticking band.

DISCLOSURE OF INVENTION

According to the present invention, a shoe is provided comprising an upper portion attached to a sole portion including a heel and a movable band attached to the upper portion of the shoe for holding it to the foot of a wearer when the band is moved to a closed position, and for effecting removal of the shoe from the foot when the band is moved to an opened position. A circuit panel is mounted on the upper portion of the shoe for producing a speaker drive signal when the panel is activated. A speaker is mounted in the shoe and is responsive to a speaker drive signal produced by the panel for producing an audio signal. Finally, a power supply is provided for actuating the circuit panel only in response to movement of the movable band to its open position. In this manner, the circuit panel will cause the speaker to produce an audible sound, such as a melody, whenever the movable band is open. This will occur when the band becomes loosened during play, thereby providing a pleasant signal to the wearer that warns him to refasten the movable band and secure the shoe to his foot.

In the preferred embodiment of the invention, the movable band includes means for releasably holding the band in its closed position, and the power supply is in the form of a photovoltaic cell that is covered by the band when the latter is in its closed position, and uncovered when the band is in its opened position. Preferably, the means for releasably holding the band in its closed position includes a first Velcro pad on the inside of the band, and a second Velcro pad on the outside of the upper portion of the shoe.

BRIEF DESCRIPTION OF DRAWINGS

Embodiments of the present invention are described in connection with the accompanying drawings wherein.

DETAILED DESCRIPTION

Figure 1:
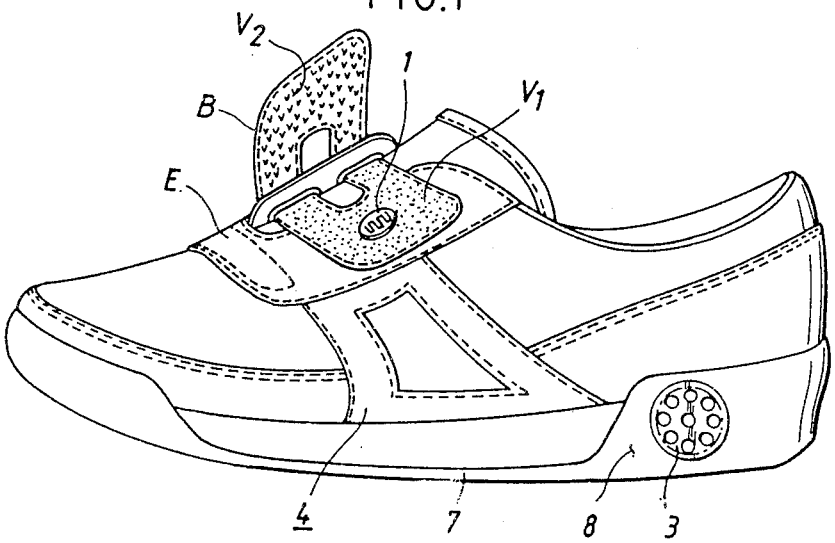
FIG. 1 is a perspective view of a shoe according to a first embodiment of the present invention showing the movable band in its opened position exposing a photosensitive element to light.
Figure 2:
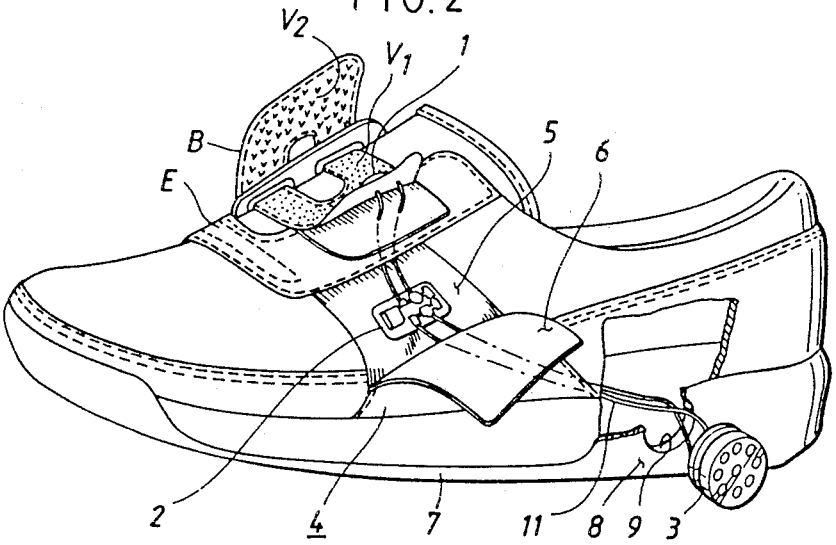
FIG. 2 is a perspective view of the shoe shown in FIG. 1 but with portions of the shoe removed for the purpose of illustrating the manner of placement of the device according to the present invention.

Turning now to the drawings, reference is made to FIGS. 1 and 2 of the drawings which show the first embodiment of the present invention. The drawings show an ordinary sports shoe comprising an upper portion attached to a sole portion 7 including heel portion 8, and movable band B attached to U-shaped eyelet stay E fastened to the upper portion of the shoe which is reinforced by a lateral reinforcing fabric 4 on each side of the eyelet stay. Band B is movable from an open position, at which the foot of a wearer may be inserted into or removed from the shoe, and a closed position overlying the eyelet stay. Band B is releasably held in its closed position (not shown) by means of first Velcro pad V2 on the inside of the band, and a second Velcro pad V1 on the outside of eyelet stay E.

Circuit panel 2 is mounted on the upper portion of the shoe and provides a speaker drive signal when the panel is activated. Speaker 3, mounted in the shoe, is responsive to the speaker drive signal produced by the circuit panel for producing an audio signal such as a melody stored in panel 2. Power supply 1 is provided for activating the circuit panel; and is effective to activate the circuit panel only in response to movement of the sticking band to its opened position. As shown in FIG. 1, the power supply is in the form of a photovoltaic cell such as a cadmium sulfide photocell, mounted on Velcro pad V1. Suitable wires 11 interconnect circuit panel 2 between power supply 1 and speaker 3.

In the preferred construction shown in FIG. 2, circuit panel 2 is sealed between inner lining 5 of the upper portion of the shoe and outer lining 6, both of which constitute lateral reinforcing fabric 4. Furthermore, lateral hindpart 8 of the heel of the shoe is provided with aperture 9 for receiving speaker 3.

In operation, the exposure of photovoltaic cell 1 to light when band B is in its opened position will supply power to circuit panel 2 causing the latter to be activated and produce a speaker drive signal that is applied to speaker 3 causing the latter to emit a melody in accordance with information stored in circuit panel 2. When movable band B is moved to its closed position such that Velcro pads V1 and V2 interengage and releasably hold band B in its closed position, band B covers the photovoltaic cell; being deprived of light, cell 1 deactivates circuit panel 2 causing sound emission from speaker 3 to terminate. Thus, when the wearer opens band B for inserting his foot into the shoe, the photovoltaic cell is exposed to light and a melody is emitted from speaker 3. Thereafter, the wearer moves band B to its closed position fastening the shoe to the foot of the wearer and depriving photovoltaic cell 1 of light thereby terminating emission of sound from speaker 3.

Should band B become loosened during the time the wearer has the shoe on, such as during play, the photovoltaic cell will become exposed to light thereby activating the circuit panel and causing the speaker to emit sound. This will provide an amusing warning to the wearer to refasten band B to securely hold the shoe to the foot.

Figure 3:
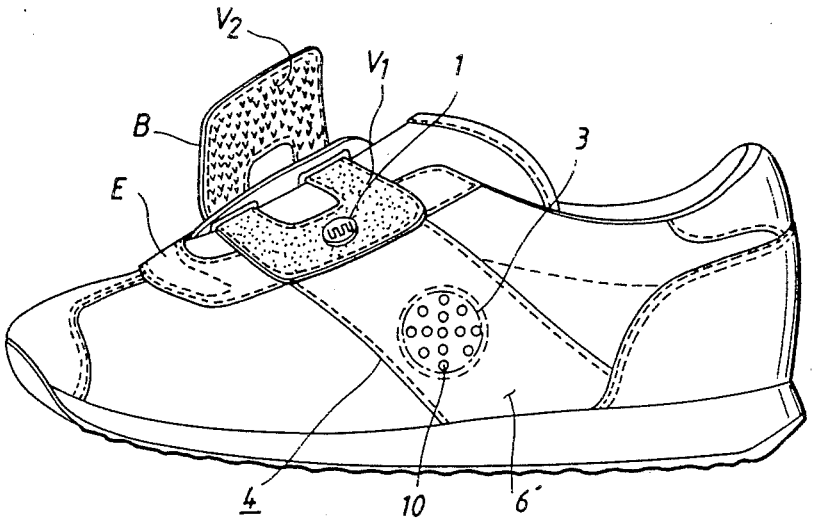
FIG. 3 is a perspective view of a second embodiment of the present invention wherein the speaker is set inside the lateral reinforcement fabric of the upper portion of the shoe.
Figure 4:
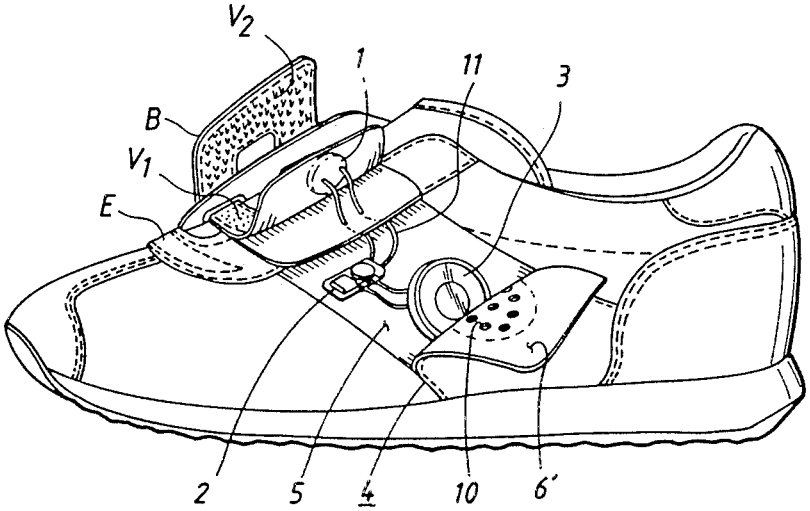
FIG. 4 is a further view of the embodiment shown in FIG. 3 with portions of the shoe removed for better illustrating the construction of the invention.

FIGS. 3-4 illustrate the second embodiment of the present invention wherein speaker 3 as well as circuit 2 is placed between inner lining 5 and outer lining 6' of the lateral reinforcing fabric of the shoe. In such case, the outer lining 6' is provided with holes 10 to effect the passage of sound produced by speaker 3. The second embodiment of the invention is particularly suitable for support shoes whose soles are made from relatively solid material, and in case the sole is made from polystyrene foam or the like.

It is believed that the advantages and improved results furnished by the method and apparatus of the present invention are apparent from the foregoing description of the preferred embodiment of the invention. Various changes and modifications may be made without departing from the spirit and scope of the invention as described in the claims that follow.

I claim:

1. A shoe comprising:

(a) an upper portion attached to a sole portion, a movable band attached to the upper portion of the shoe for holding it to the foot of a wearer when the band is moved to a closed position, and for effecting removal of the shoe from the foot when the band is moved to an opened position, and means for releasably holding the band in its closed position;

(b) a circuit panel mounted on said upper portion for providing a speaker drive signal when activated;

(c) a speaker mounted in said shoe for producing an audio signal in response to a speaker drive signal produced by said circuit panel; and (d) a power supply for activating said circuit panel only in response to movement of said band to its opened position;

(e) said power supply being in the form of a photovoltaic cell that is covered by said movable band when the latter is in its closed position and uncovered when the band is in its opened position.

2. A shoe according to claim 1 wherein said means for releasably holding the band in its closed position includes a first Velcro pad on the inside of said band and a second Velcro pad on the outside of the upper portion of the shoe, engageable by the first pad when the band is in its closed position.

3. A shoe according to claim 2 wherein the upper portion of said shoe includes a U-shaped eyelet stay on the instep of the upper portion of the shoe that defines an opening in said upper portion through which the foot of a wearer may be inserted into the shoe, and a pair of lateral reinforcing strips extending from the eyelet stay to the sole, said circuit panel being positioned beneath one of the reinforcing strips.

4. A shoe according to claim 3 wherein said speaker is positioned in the heel of the shoe.

5. A shoe according to claim 3 wherein the speaker is positioned under one of the reinforcing straps.

6. A shoe according to claim 3 wherein said speaker is positioned under the same reinforcing strap as the circuit panel.

7. A shoe according to claim 6 wherein the portion of the reinforcing strip overlying the speaker is provided with a plurality of holes.

8. A method for signaling that a movable band that holds the foot of a wearer in a shoe has become loose comprising the steps of:

(a) mounting on the shoe a circuit panel that produces a speaker drive signal when activated;

(b) mounting on the shoe a speaker responsive to a speaker drive signal produced by said circuit panel for producing an audio signal; and (c) mounting on the shoe a power supply in the form of a photovoltaic cell that is exposed to light when the movable band is moved to a loose position for activating said circuit panel only in response to movement of said band to a loose position.

* * * * *